United States Patent [19]

Robbins, III

[11] Patent Number: 5,054,631

[45] Date of Patent: Oct. 8, 1991

[54] DISPOSABLE BEVERAGE CONTAINERS HAVING INTEGRAL DRINKING STRAWS

[76] Inventor: Edward S. Robbins, III, 459 North Ct., Florence, Ala. 35630

[21] Appl. No.: 411,893

[22] Filed: Sep. 25, 1989

[51] Int. Cl.[5] ..... B65D 25/46; B65D 25/48; B65D 1/46

[52] U.S. Cl. ..... 215/1 A; 215/1 C; 215/229; 220/85 SP; 220/90.2; 220/666; 229/103.1; 222/530

[58] Field of Search ..... 215/1 A, 229, 1 C; 220/90.2, 85 SP, 90.4, 907; 229/1.5 B, 103.1; 222/530, 211, 107; 239/33; 383/906, 666,

[56] References Cited

U.S. PATENT DOCUMENTS

| | | | |
|---|---|---|---|
| 662,345 | 11/1900 | Britton et al. | 239/33 |
| 2,950,029 | 8/1960 | Winstead | 383/906 X |
| 2,957,614 | 10/1960 | Krajcovic | 229/103.1 |
| 3,240,415 | 3/1966 | Pugh, Sr. | 229/103.1 |
| 3,279,679 | 10/1966 | Engelsher et al. | 229/103.1 |
| 3,303,984 | 2/1967 | Jurena | 229/103.1 |
| 3,362,607 | 1/1968 | Weitzner | 229/103.1 |
| 3,367,380 | 2/1968 | Dickey | 383/906 X |
| 3,462,061 | 8/1969 | Shore | 229/103.1 |
| 3,486,679 | 12/1969 | Pfahler | 229/103.1 |
| 3,730,737 | 5/1973 | Harvey et al. | 229/103.1 X |
| 3,799,914 | 3/1974 | Schmit et al. | 215/1 A X |
| 3,874,554 | 4/1975 | Chang | 215/1 A X |
| 3,944,124 | 3/1976 | Hexel | 229/1.5 B |
| 4,036,392 | 7/1977 | Martin | 229/103.1 X |
| 4,043,478 | 8/1977 | Duncan | 215/1 A X |
| 4,243,162 | 1/1981 | Klygis | 215/1 C X |
| 4,407,425 | 10/1983 | Combs | 229/103.1 X |
| 4,573,631 | 3/1986 | Reeves | 220/90.2 X |
| 4,699,318 | 10/1987 | Donatello et al. | 215/1 A X |
| 4,718,778 | 1/1988 | Ichikawa | 239/33 X |
| 4,781,880 | 11/1988 | Robbins, III | 264/521 |
| 4,798,324 | 1/1989 | Gannon | 229/103.1 X |
| 4,816,093 | 3/1989 | Robbins, III | 264/515 X |
| 4,830,204 | 5/1989 | Lin | 215/1 A |
| 4,836,970 | 6/1989 | Robbins, III | 264/515 |

FOREIGN PATENT DOCUMENTS

| | | | |
|---|---|---|---|
| 213673 | 3/1987 | European Pat. Off. | 229/103.1 |
| 2631437 | 2/1977 | Fed. Rep. of Germany | 215/1 A |
| 87/02873 | 5/1987 | PCT Int'l Appl. | 224/148 |
| 978901 | 1/1965 | United Kingdom | 229/103.1 |

OTHER PUBLICATIONS

"Making it Harder for Kids to Spill", Wall Street Jounal, May 31, 1989, page B1.

*Primary Examiner*—Sue A. Weaver
*Attorney, Agent, or Firm*—Nixon & Vanderhye

[57] ABSTRACT

A one-piece container for potable liquids (e.g., beverages) includes a body portion formed of a plastics material and sized to accommodate a predetermined volume of potable liquid, and a drinking straw in fluid communication with the potable liquid within the body portion. A flexible bellows member interconnects the straw to the body portion so as to allow the straw to be foldable between a stowed position (e.g., during periods of nonuse) and an erected position (e.g., during periods of use). A recess may be formed in the body portion (e.g., in a side wall and/or an upper portion thereof) so as to accommodate the drinking straw in its stowed position. Longitudinal rigidity and stability may be provided by a series of circumferentially spaced-apart ribs integrally formed on the otherwise flexible (and collapsible) body portion.

9 Claims, 6 Drawing Sheets

FIG. 6
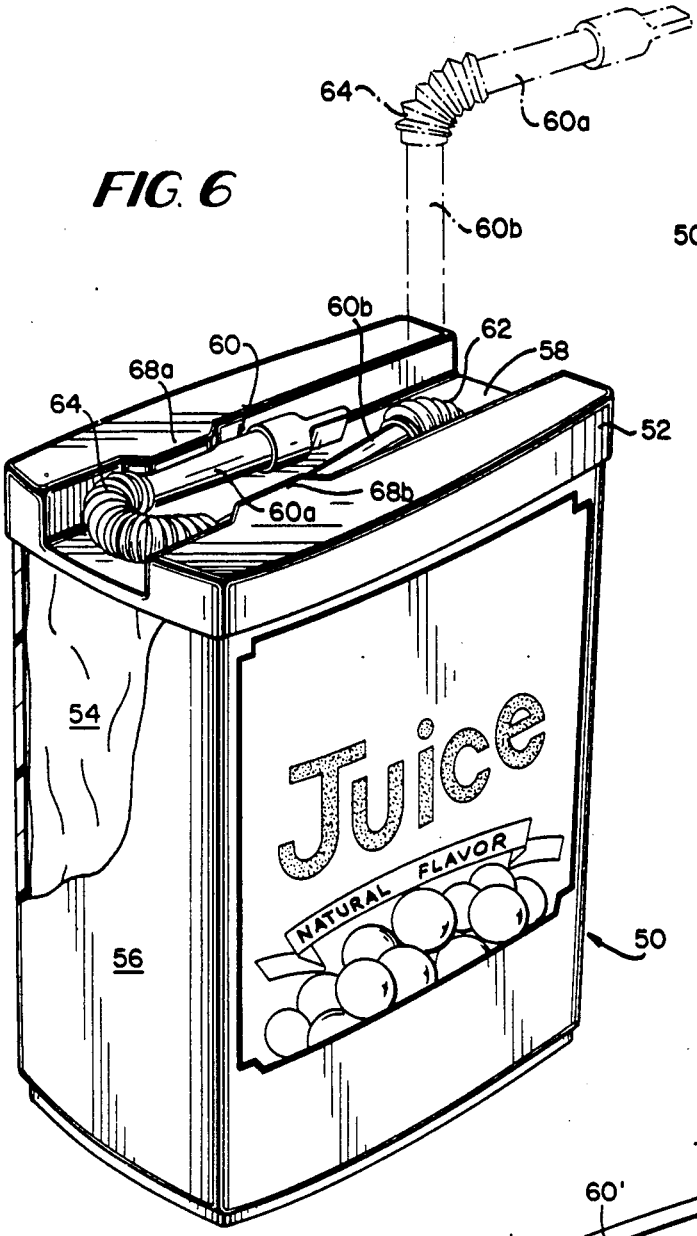
FIG. 7
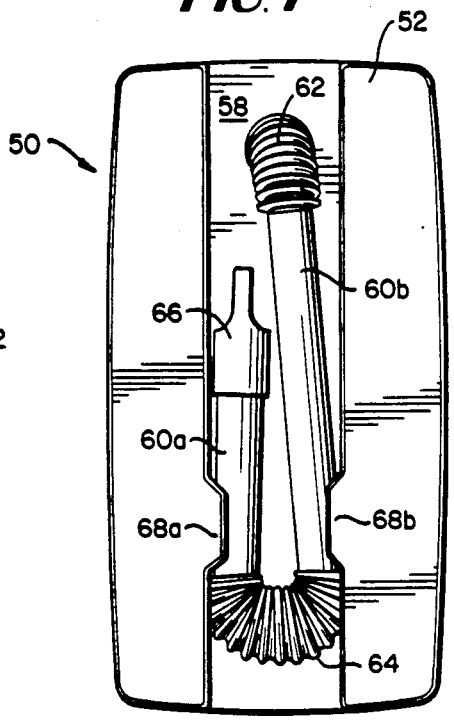
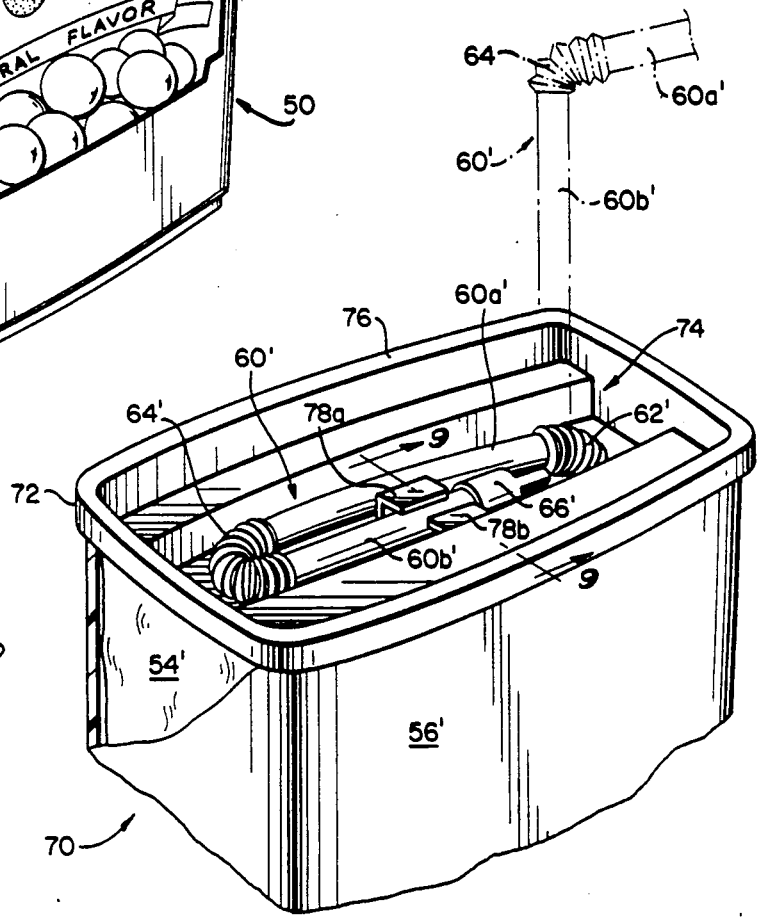
FIG. 8

DISPOSABLE BEVERAGE CONTAINERS HAVING INTEGRAL DRINKING STRAWS

FIELD OF INVENTION

This invention is generally related to containers of the type adapted to contain potable liquids, for example liquid beverages. The invention, in its preferred embodiments, includes a "thin-film" collapsible container body with a rigid (e.g., self-supported) drinking straw integrally connected to the container body so as to be in fluid communication with the container's contents.

BACKGROUND AND SUMMARY OF THE INVENTION

A variety of potable liquids (e.g., fruit juice and similar non-carbonated beverages) have recently been packaged in single serving, disposable containers usually formed of liquid impervious paper board material or a metallized film. These conventional containers are typically provided with a discreet drinking straw which is itself packaged in a sealed film envelope adhered to an exterior surface of the container. These containers also have an opening which is sized so as to accept the accompanying straw and is normally closed via a rupturable cover. In use, the consumer will detach the accompanying straw and will puncture the cover of the container's opening so as that the beverage may be withdrawn through the straw.

These typical containers have several problems. For example, the containers usually need to be collapsed during use so as to assist in removal of the beverage contents through the straw. However, once the straw has ruptured the cover of the opening, there is really no effective seal formed between the straw and the container. Thus, squeezing the container during use usually results in the liquid beverage leaking through the opening and onto the consumer's hands, clothing, etcetera. In addition, the straws that accompany these conventional containers are typically of insufficient length (e.g., due to the geometry of the containers and the need to physically attach a straw to the container's exterior surface) to allow the entire contents of the container to be consumed.

Recently, it has been proposed to provide a separate reusable holder for the conventional beverage containers mentioned above (see, Wall Street Journal, May 31, 1989, page B1). In essence, the reusable container holder is intended to provide protection against the spillage and leakage problems associated with the beverage containers as discussed above, in addition to providing its own straw of sufficient length to allow the entire contents of the container to be consumed. Obviously, a separate holder for the beverage containers is not a satisfactory solution since it assumes that a consumer will always have such a holder at hand when it is desired to consume a beverage.

It would therefore be very desirable if self-contained packaging was provided for beverages which preserved the convenience of the conventional collapsible beverage containers described above, yet minimized (if not prevented) the spillage and leakage problems associated with such containers. And, it would be very desirable if means were provided so as to more readily facilitate easier consumption of the entire container contents. It is towards providing such a container that the present invention is directed.

According to the present invention, containers having a thin-film (i.e., readily collapsible) body portion are provided with integral drinking straws. Preferably, the drinking straw and the thin film body portion are formed as a one-piece container so that the need to provide a drinking straw separately of the container is obviated.

In some embodiments, the body portion will include means which serve to rigidify the body portion of the container along its longitudinal extent and thereby allow the container to be "free standing" even when partially or completely emptied of its contents. Such means may, for example, be in the form of integral (and preferably unitary) longitudinally extending ribs and/or longitudinally extending pleats, each of which may be disposed about the circumference of the container. In other embodiments, the thin film body portion is provided as a liner to an external rigid housing so as to allow the container to be free standing.

In particularly preferred embodiments, the integral drinking straw is stored during periods of nonuse in a recess associated with a portion of the container (e.g., a recess formed in the container's body or top portions), and may be erected to allow the container's contents to be consumed. In this manner, the containers of this invention may be easily stacked for shipment and/or retail sales, while providing the consumer with ready access to the container's contents. And, inadvertent spillage may be minimized (or eliminated) by providing an integral drinking straw which may simply be housed within a recess of the container.

These aspects of the present invention, and others, will become more clear to the reader after careful consideration is given to the detailed description of the preferred exemplary embodiments thereof which follow.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 6 is a perspective elevational view, partially in cross-section of one exemplary composite container according to the present invention;

FIG. 7 is a top plan view of the composite container shown in FIGURE 6;

FIG. 8 is a partial perspective elevation view of another composite container according to the present invention;

DETAILED DESCRIPTION OF THE PREFERRED EXEMPLARY EMBODIMENTS

Figure 1:
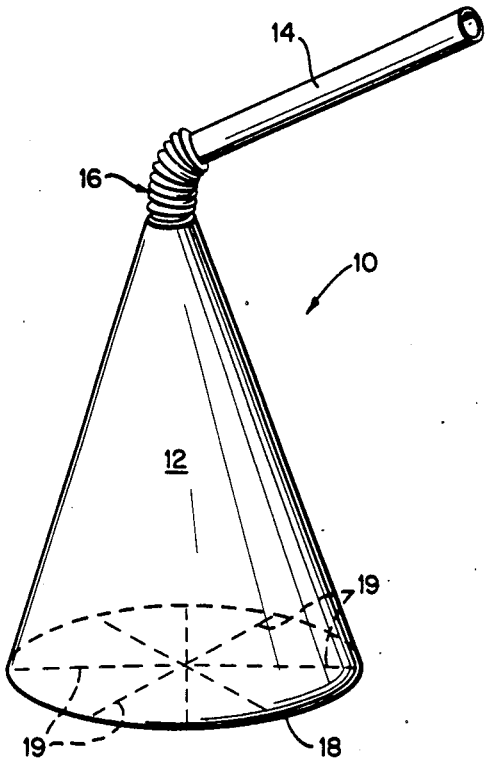
FIG. 1 is a perspective elevational view of a particularly preferred embodiment of a collapsible and disposable container according to the present invention.

Accompanying FIG. 1 shows a particularly preferred embodiment of a collapsible and disposable container 10 according to this invention. As is seen, the container 10 is comprised of a thin film, essentially conical container body 12 and a straw member 14 integrally connected to the container body 12 via a flexible tubular bellows section 16. The straw 14 is thus in fluid communication with the liquid beverage contents within the container body 12 via the tubular bellows section 16 so that the consumer may withdraw the beverage through the straw 12 during use.

Although the container body 12, tubular bellows 16 and straw 14 could be formed separately and then integrally united in any expedient fashion (e.g., via heat welding, adhesive bonding and the like), it is presently preferred that these structures be unitary with one another (i.e., one-piece) and formed of the same thermoformable resin (e.g., polyolefins such as polyethylene, polypropylene, and the like, or polyesters such as polyethylene terephthalate, polybutylene terephthalate, and the like). In this regard, it is presently preferred that the container 10 according to the present invention (as well as the other embodiments of the containers within the scope of this invention to be described below) be formed according to extrusion or injection blow molding techniques such as described more completely in commonly owned U.S. Pat. No. 4,836,970 and commonly owned, copending U.S. application Ser. No. 07/332,994 filed Apr. 4, 1989 (the entire content of each being expressly incorporated hereinto by reference).

It will be appreciated that the "thickness" of the thin-film container body 12 may vary in dependance upon the size of container 10 and/or the particular thermoformable resin that is employed. However, the container body 12 must be sufficiently "thin" so as to be readily collapsible in use and is therefore not capable of supporting its own weight when empty. When filled with liquid, however, the container body 12 will stand upright due to the liquid contained therein. This ability of the container 10 to stand upright when filled with liquid is enhanced by providing an enlarged base 18 on the container body 12 and fashioning the side walls in a conical or other upwardly tapered configuration. Additional stability during use (e.g., so as to allow the container to be set upon a surface and stand upright when filled with a liquid) may be facilitated via radially positioned integral ribs on the exterior or interior surface of the container body 12 bottom wall 18 (e.g., as noted in dashed line by reference numeral 19 in FIG. 1).

Figure 2A:
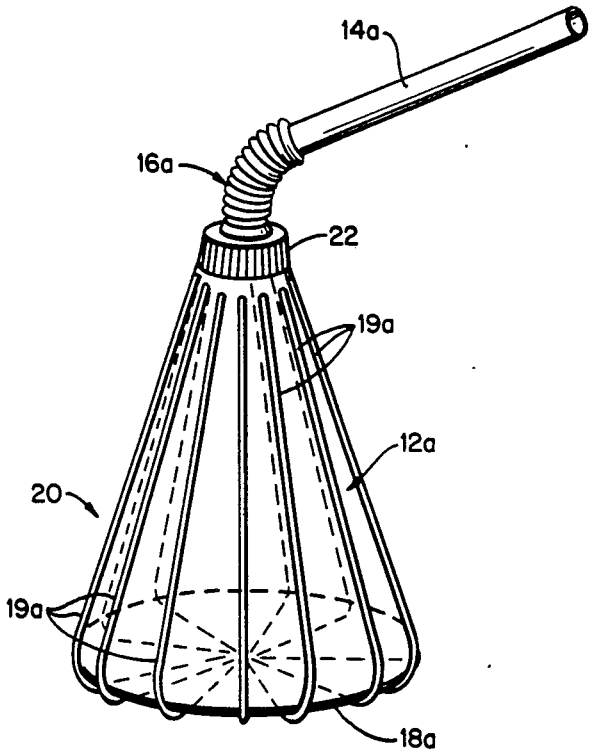
FIG. 2A is a perspective elevational view of another container embodiment according to this invention.

The container 20 shown in FIG. 2A is similar to the container 10 described above with respect to FIG. 1 but includes a number of circumferentially spaced-apart ribs 19*a* extending longitudinally along the exterior surface of the thin-film container body 12*a*. The lower portion of these ribs 19*a* radially converge towards the center of the container body's bottom wall 18*a*. The longitudinally extending and radially converging ribs 19*a* of container 20 thereby provide increased structural rigidity in the longitudinal dimension and thus impart self-supporting functions to the otherwise non-self-supporting side wall of container body 12*a*. However, it will be appreciated that these ribs 19*a* are separated by the thin film material of the container body 12*a* so that the container body 12*a* is still collapsible during use.

In addition, the container 20 includes an upper region 22 of container body 12*a* that is relatively thick (i.e., rigid and self-supporting). The region 22 is integrally connected to the tubular bellows section 16*a* and serves to allow the straw 14*a* to be foldably manipulated without collapsing the upper part of the container body 12*a* (thereby minimizing disruption of the fluid communication between the straw 14*a* and the liquid within the container body 12*a* that may otherwise occur). The region 22 is preferably unitary (i.e., in one-piece) with the container body 12*a* and the tubular bellows section 16*a*. However, region 22 may be in the form of a removable screw cap, in which case suitable mating threads (not shown) are formed in a thickened upper region of the container body 12*a*. And, region 22 may, if desired, be formed separately of the remaining structural elements shown in FIG. 2A and then integrally assembled therewith via heat-welding, adhesive or like techniques.

Figure 2B:
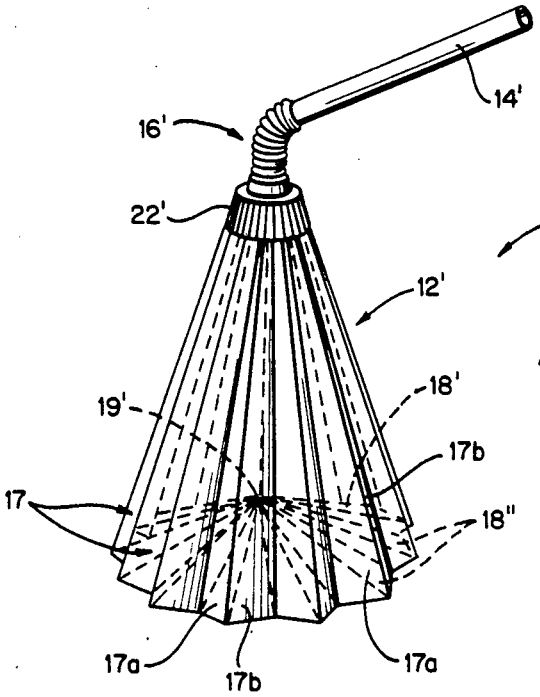
FIG. 2B is a perspective elevational view of yet another container embodiment according to this invention.

FIG. 2B shows another embodiment of a container 10′ according to the present invention. Similar to the container embodiment shown in FIG. 2A, container 10′ shown in FIG. 2B is generally conically shaped and includes an integral drinking straw 14′ connected to a rigid upper region 22′ via a foldable bellows section 16′. The region 22′ may be integral with (e.g., one-piece) the container body 12′, or may be in the form of a removable screw cap, in which case suitable mating threads (not shown) are formed in a thickened upper region of the container body 12′.

The container body 12′is formed of a "thin film" plastic which normally does not exhibit sufficient longitudinal stiffness such that the container body is capable of supporting its own weight when empty. However, according to the embodiment of the container 10′ shown in FIG. 2B, increased longitudinal stiffness (and hence self-supporting capability) is imparted to the container body 10′ via a plurality of longitudinally extending pleats 17 disposed about the circumference of the container body. The pleats 17 are formed by means of a number of pairs of generally triangular-shaped panels 17*a*, 17*b* which, collectively with adjacent pairs of panels 17*a*, 17*b*, form a number of longitudinally extending and circumferentially separated peaks and valleys which converge towards the upper region 22′.

The base 18′ may likewise be formed with a number of pleats 18′ which converge at the center 19′ of the base 18′ and thus establish a concavity relative to a surface upon which the container body 12′ rests. Alternatively, the base 18′ may be non-pleated as shown in FIG. 1, in which case it may optionally be provided with ribs 19 as depicted therein.

Figure 3:
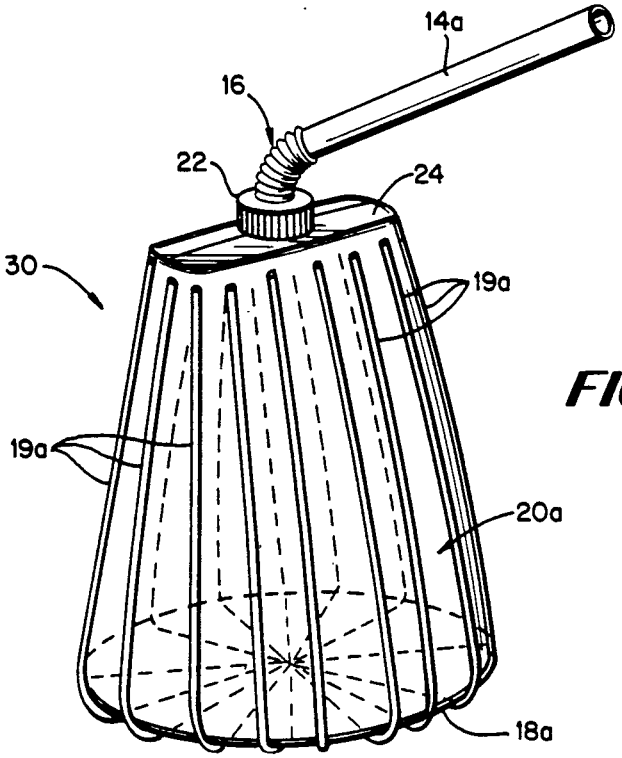
FIG. 3 is a perspective elevational view of another container embodiment according to this invention.

The container 30 shown in FIG. 3 is essentially similar to container 20 described above with reference to FIG. 2A except that it has a slightly different geometric shape. In this regard, the container 30 includes opposing pairs of side walls forming the container body 20*a* that converge towards an upper wall 24. The upper wall 24 is preferably of sufficient thickness so as to essentially be rigid and thus supports the thickened region 22 integrally associated therewith.

Figure 4:
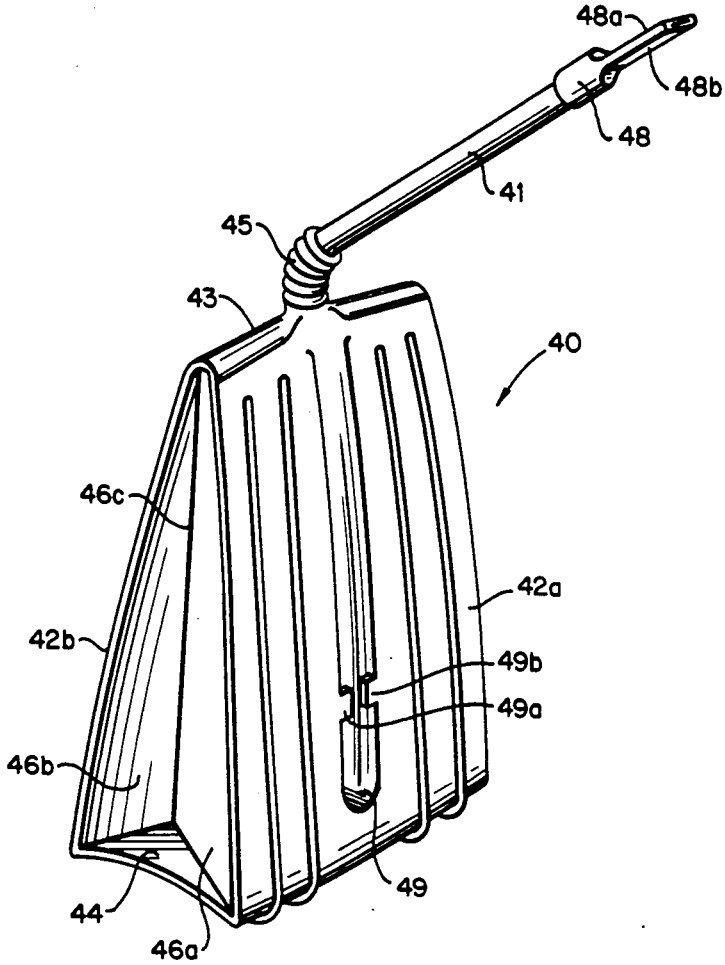
FIG. 4 is a perspective elevational view of yet another container embodiment according to this invention shown with the integral straw thereof in a "ready-to-use" position.
Figure 5:
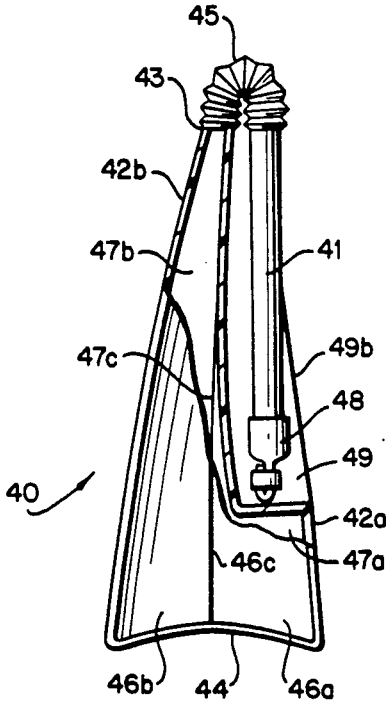
FIG. 5 is a side elevational view, partly in cross-section, of the container shown in FIG. 4 but with the integral straw thereof in a stowed position.

Accompanying FIGS. 4 and 5 show another preferred embodiment of a container 40 according to the present invention. As is seen, the container 40 includes a straw 41 integrally connected to the top region 43 via an integral bellows section 45. The container 40 is formed principally by means of a pair of opposing front and rear panels 42*a*, 42*b* which upwardly converge from a concave bottom wall 44 toward the top region 43. These front and rear panels 42*a* and 42*b* are joined to one another and to the bottom wall 44 via front and rear pairs of generally triangular shaped side panels 46*a*, 46*b* and 47*a*, 47*b* (see FIG. 5).

The side panels 46*a*, 46*b* and 47*a*, 47*b* inwardly converge and meet along a vertical midline 46*c* and 47*c*, respectively, of the container 40. In use, a consumer will apply pressure against the front and rear panels 42*a* and 42*b* so as to cause the opposing panels 46*a*, 46*b* and 47*a*, 47*b* to collapse towards one another. This will, in turn, encourage the liquid beverage in the container 40 to flow upwardly toward the integral straw 41.

The terminal end of straw 41 is preferably provided with a mouthpiece 48 which includes a pair of flexible lips 48*a*, 48*b*. These lips 48*a*, 48*b* thereby serve to provide a one-way valving structure so as to close the straw 41 when the consumer has finished drinking the container's contents. That is, the lips 48*a*, 48*b* will separate under suction to allow the liquid beverage to be withdrawn through the straw 41, but will resiliently return to a "closed" condition as shown in FIG. 4 when the suction is removed.

During periods of non-use (or for retail sales purposes) the straw 41 may be housed within the longitudinally (essentially vertically) extending recess 49 formed in the front panel 42*a* as is shown more clearly in accompanying FIG. 5. The recess 49 may also be provided with an opposing pair of detent members 49*a*, 49*b* which serve to retain the straw 41 within the recess 49. As shown particularly in FIG. 5, the detent members 49*a*, 49*b* extend towards one another and serve to retain the straw 41 therebeneath when it is in a stowed position within the recess 49. These detent members 49*a*, 49*b* are, moreover, resilient so that the straw 41 may simply be pulled through the small clearance space defined between the detent members 49*a*, 49*b*. In this regard, the detent members 49*a*, 49*b* will resiliently bend outwardly (and thus separate to allow the straw 41 to pass therethrough), but will return to their normal condition as noted in FIG. 4, once the straw 41 has been removed from the recess 49.

Accompanying FIGS. 6 and 7 show another embodiment of a container 50 according to the present invention. As is seen, the container 50 includes an essentially rigid (and normally self-supporting) upper region 52 and an integral (preferably unitary) flexible liner portion 54 dependently attached to the upper region 52 and housed within an outer container body 56. The container body 56 is preferably rigid so as to provide free standing capabilities for the container 50 (which capabilities would not be present if the flexible (and non-self-supporting) liner 54 was employed alone).

The upper region 52 defines an elongate channel 58 which houses the integral straw 60 during periods of nonuse. The straw 60 itself is provided with proximal and distal bellows sections 62, 64, respectively, so that the distal straw segment 60*a* is capable of being folded into adjacent relationship with the proximal straw segment 60*b* as is shown perhaps more clearly in FIG. 7. The straw 60 may, however, be erected such that it extends outwardly from the container 50 as shown in phantom line in FIG. 6 so that the consumer can withdraw the container's contents. In this regard, the straw 60 preferably includes a flexible mouthpiece 76 which, like mouthpiece 48 described previously serves as a one-way valving mechanism to allow liquid contents to be discharged therefrom under suction but which minimizes spillage when suction is discontinued.

In order to retain the straw 60 in its folded and stowed condition as shown in FIGS. 6 and 7, the top portion 52 of container 50 preferably includes a pair of opposing detent members 68*a*, 68*b*. Regions of the proximal and distal straw segments 60*a*, 60*b* will therefore be captured under the detent members 68*a*, 68*b*, respectively, so as to retain the straw 60 within the channel 58. The straw segments 60*a* and/or 60*b* may, however, be manipulated so as to allow the straw 60 to be erected as described previously when it is desired to consume the contents of container 50.

The container 70 shown in accompanying FIG. 8 is similar to the container 50 described above with reference to FIGS. 6 and 7, except in the configuration of its top portion 72. (Structural elements of container 70 which are similar to structural elements of container 50 have the same reference numerals but are followed by a prime (') designation.) As is seen, the top portion 72 includes an elongate channel 74 which is recessed relative to an upper annular edge 76 of the top portion 72. Thus,. the straw 60', when in its stowed position within channel 74, is likewise recessed relative to the upper edge 76. In this manner, other similar containers 70 may be stacked one on top of another so as to conserve valuable retail shelf and/or shipping space.

Figure 9:
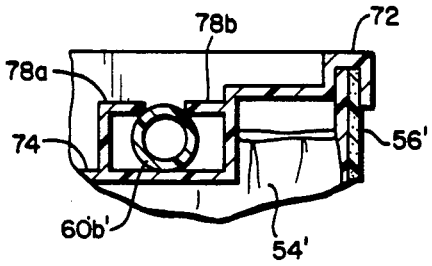
FIG. 9 is a detailed cross-sectional view of the straw-retaining means employed in the container shown in FIG. 8 and taken along line 9—9 therein.

The distal straw segment 60*b'* is held in its stowed condition within the channel 74 by means of a pair of detent flanges 78*a*; 78*b*. As is shown more clearly in FIG. 9, the detent flanges 78*a* and 78*b* are laterally separated so as to define a space therebetween which is somewhat less in dimension as compared to the diameter of the straw segment 60*b'*. However, the detent flange 78*a* will yieldably separate from flange 78*b* when the straw segment 60*b'* is forced therebetween and will return to the position shown in FIG. 9 under its own resilient tendency. In such a manner, the straw 60 will be removably captured by the detent flanges 78*a*, 78*b* and will, moreover, be retained within the channel 74.

A particularly preferred embodiment of a container 100 according to the present invention is shown in accompanying FIGS. 10—13. As is seen particularly in FIG. 10, the container 100 includes a rigid upper portion 102 and a flexible liner portion 104 which is dependently connected to the upper portion 102 and is housed within an exterior container body 106.

The upper portion 102 of container 100 includes a "pop-up" dome region 110 which is formed by means of an annular tapered sidewall 112 and planar surface region 114. An integral straw 116 comprised of proximal and distal straw segments 116*a*, 116*b* (flexibly interconnected via a bellows section 116*c*) is connected to the surface 114 of dome region 110 via bellows section 116*d*. The straw 116 moreover preferably includes a mouthpiece 118 for a similar purpose as has been previously described.

Figure 12:
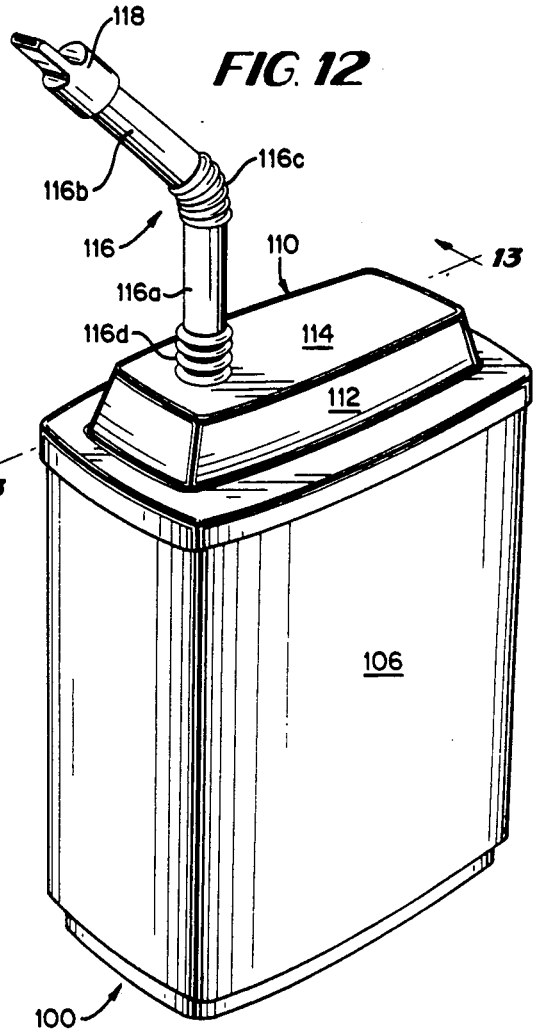
FIG. 12 is a perspective view of the composite container shown in FIG. 10 but with the integral straw thereof in a "ready-to-use" position.
Figure 10:
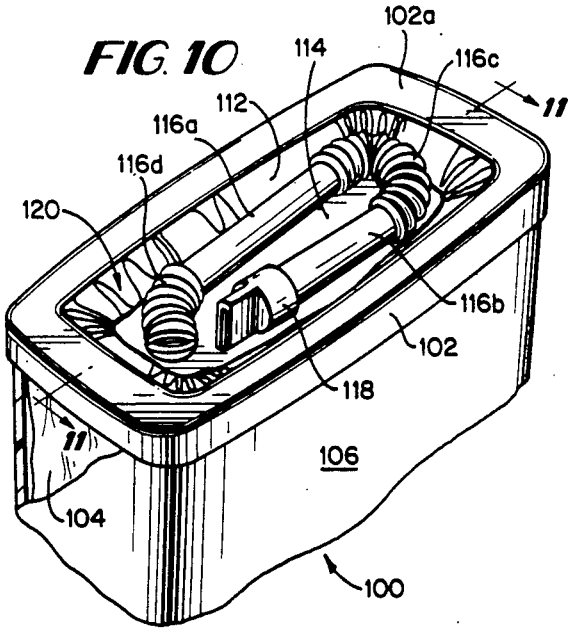
FIG. 10 is a partial perspective view of yet another composite container according to the present invention showing the integral straw thereof in a stowed position.
Figure 11:
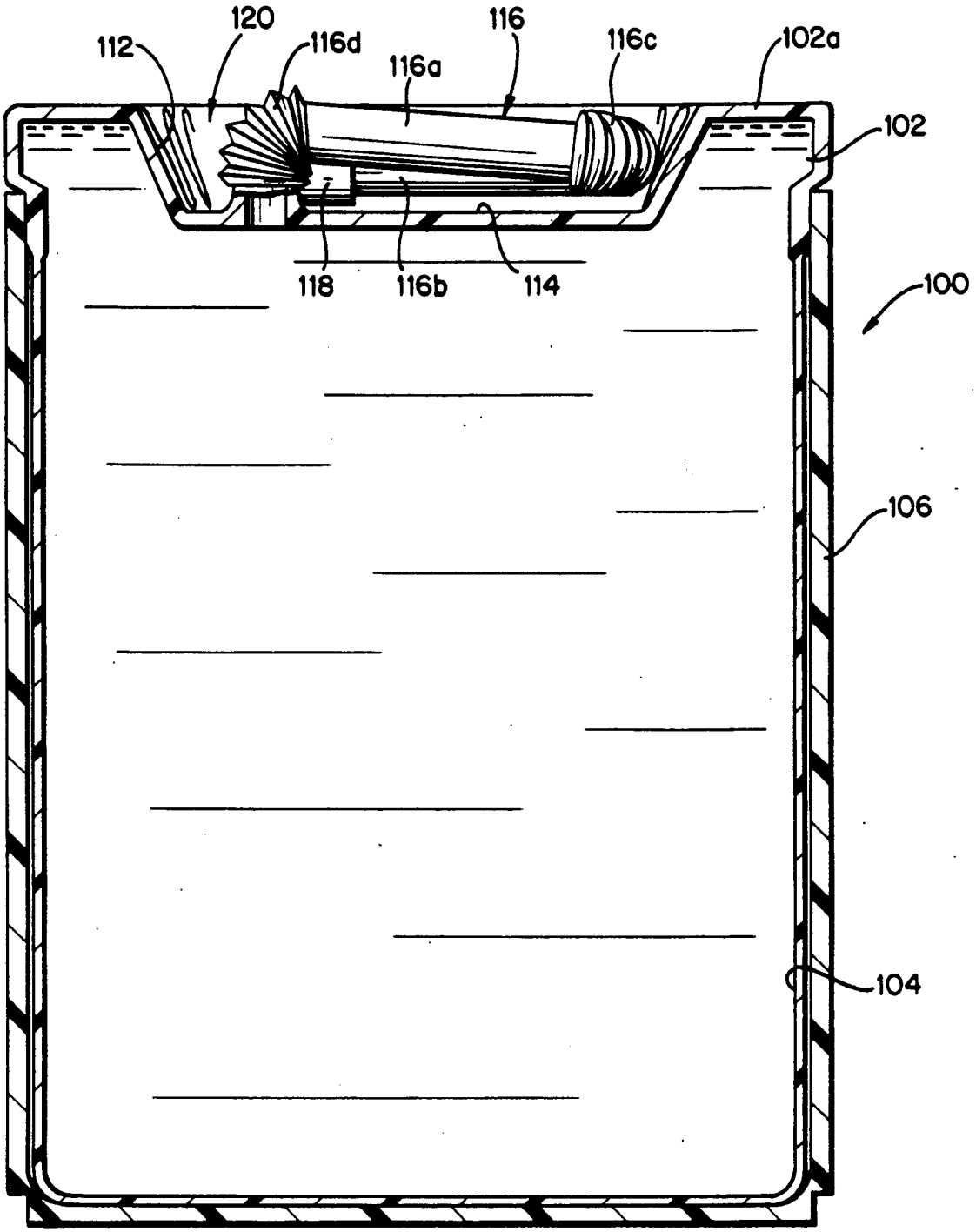
FIG. 11 is a cross-sectional elevation view of the container shown in FIGURE 1O as taken along line 11—11 therein.
Figure 13:
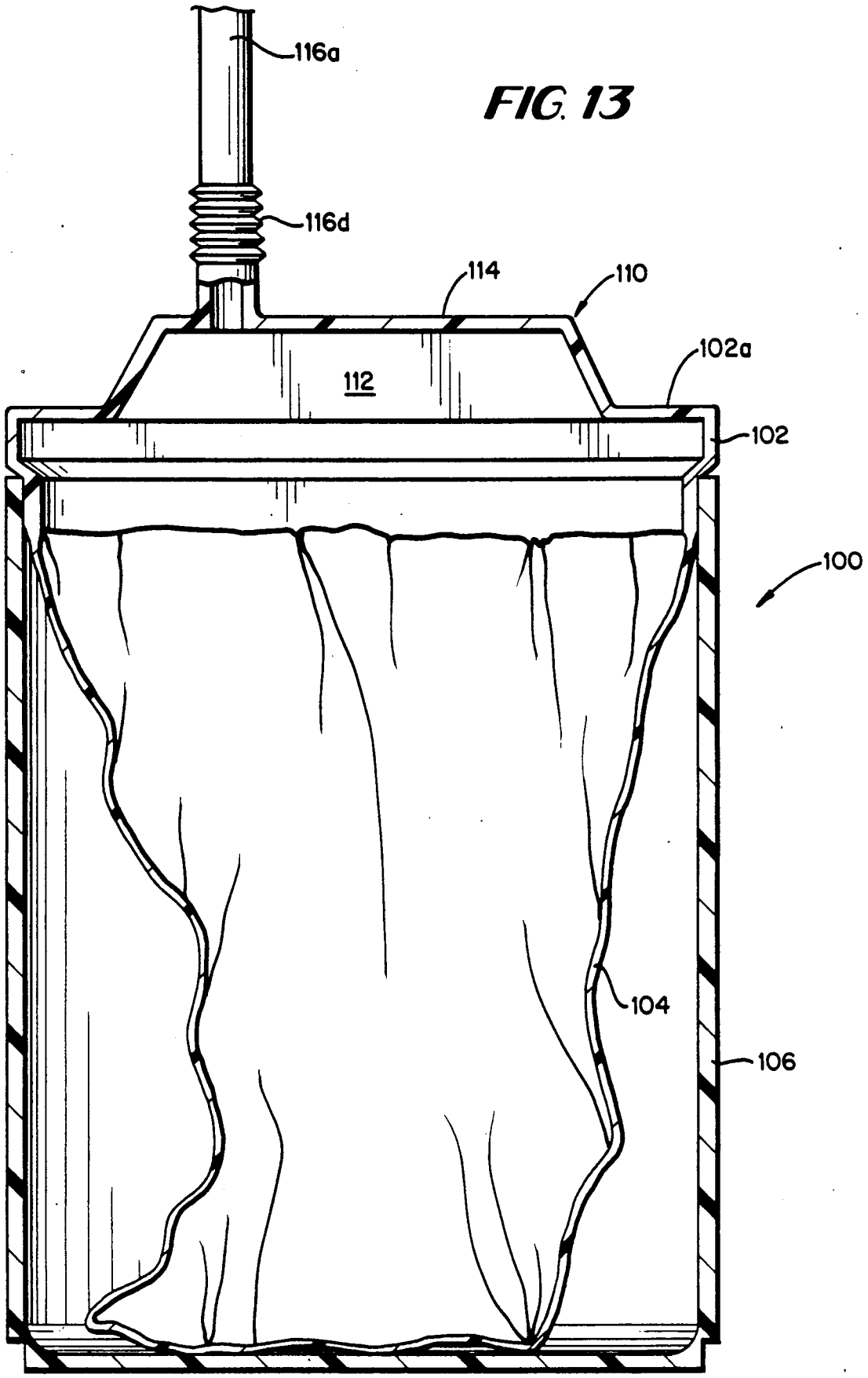
FIG. 13 is cross-sectional elevational view of the container shown in FIG. 12 as taken along line 13—13 therein.

As is shown in FIGS. 10 and 11, the dome region 110 may be forcibly depressed inwardly into the container 100 so that the surface 114 of the dome region 110 is recessed relative to the upper edge 102*a* of upper container portion 102. In such a manner, a recessed pocket may be formed in the upper portion 102 of the container 100 so as to accommodate the straw 116 in a folded configuration. However, whenever it is desired to consume the contents within the liner portion 104, the straw 116 and dome region 110 may be erected by pulling on the former so that it assumes the configuration shown in FIGS. 12 and 13. It will be understood that the thickness of the annular wall 112 and/or its upward and inward taper and/or its material of construction is selected so as to maintain the dome region 110 in its erected configuration as shown in FIGS. 12 and 13, but yet will exhibit insufficient resistance to being forcibly depressed inwardly into the container 100 to form the recessed pocket 120 as shown in FIGS. 10 and 11.

The "pop up" dome region 110 of container 100 therefore provides a convenient means whereby the straw 116 may be folded and retained in a recess (thereby allowing the containers to be stacked during shipment and/or storage), while yet also allowing the straw 116 to be erected when it is desired to withdraw the liquid beverage within the container 100.

It will be appreciated that, in order to assist in the discharge of liquid through the straw for those container embodiments having a flexible liner and a rigid outer container body, air vents are preferably formed in the latter, even though the same are not specifically depicted in the accompanying drawings. These air vents will therefore allow air to enter between the flexible liner and the rigid container body so that the flexible liner more easily collapses during use. Moreover, the rigid upper container portion may be affixed to the outer container body via any suitable means, for example, by heat sealing techniques and/or by adhesive.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A beverage container comprising:

a flexible container body which defines an interior volume for containing a liquid beverage therein;

said container body including a bottom wall, opposing front and rear panels each joined at a lower region to said bottom wall and converging towards one another at an upper region, and a pair of opposing generally triangularly shaped side panels joined to respective side edges of said front and rear panels and to said bottom wall;

a drinking straw integrally coupled to said upper regions of said front and rear panels and in fluid-communication with said interior volume for allowing a user to withdraw said contained beverage from said interior volume; and bellows means for integrally coupling said drinking straw to said container body and for allowing said drinking straw to be foldable between a stowed position wherein said drinking straw is closely adjacent said container body, and an erected position wherein said drinking straw outwardly extends from said container body, wherein said front panel of said container body includes means defining a recess sized and configured to hold said drinking straw therein when in said stowed position.

2. A beverage container as in claim 1, further comprising detent means associated with said recess defining means for releasably holding said straw within said defined recess when in said stowed position.

3. A one-piece container for potable liquids comprising:

a body portion formed of plastics material and sized to accommodate a predetermined volume of potable liquid, a drinking straw in fluid communication with the potable liquid within said body portion, and bellows means for unitarily interconnecting said body portion and said drinking straw and for allowing said drinking straw to be foldable relative to said body portion, wherein said body portion includes a bottom wall, opposing and upwardly converging front and rear panels, and an opposing pair of side walls each of which includes a pair of inwardly converging and generally triangularly shaped side panels, each said pair of side panels being joined along a midline and includes means wherein pressure applied against said front and rear panels causes said pair of side panels of said side walls to collapse towards one another along said midline thereof so as to encourage the potable liquid to be expelled through said drinking straw.

4. A container as in claim 3, further comprising means defining a recess in said body portion sized and configured to accept therein said drinking straw when folded into a stowed condition.

5. A container as in claim 4, further comprising means associated with said recess defining means for releasably holding said drinking straw in said stowed condition within said defined recess.

6. A container as in claim 3, further comprising means associated with said body portion for rigidly said body portion in a longitudinal direction.

7. A container as in claim 6, wherein said rigidifying means includes a number of longitudinally extending and circumferentially spaced apart ribs.

8. A container as in claim 1 or 3, wherein said drinking straw includes a mouthpiece.

9. A container as in claim 8, wherein said mouthpiece includes a pair of flexible lip members which open during suction of the potable liquid from said interior volume.

* * * * *